US008286942B2

(12) United States Patent
Thesier

(10) Patent No.: US 8,286,942 B2
(45) Date of Patent: Oct. 16, 2012

(54) PORTABLE LIFTING APPARATUS

(76) Inventor: Michael Robert Thesier, Cape Coral, FL (US)

( * ) Notice: Subject to any disclaimer, the term of this patent is extended or adjusted under 35 U.S.C. 154(b) by 205 days.

(21) Appl. No.: 12/799,902

(22) Filed: May 4, 2010

(65) Prior Publication Data

US 2011/0272649 A1 Nov. 10, 2011

(51) Int. Cl.
*B66F 13/00* (2006.01)

(52) U.S. Cl. ..... 254/1; 254/418; 254/2 C; 254/485; 414/485

(58) Field of Classification Search ..... 254/1, 418, 254/420, 424–425, 427, 45, 8 B, 8 C, 2 B, 254/2 C, 89 R; 414/462, 921
See application file for complete search history.

(56) References Cited

U.S. PATENT DOCUMENTS 3,117,765 A * 1/1964 Chiuzzi ..... 254/10 C
3,841,603 A * 10/1974 Lund et al. ..... 254/4 R
4,724,875 A * 2/1988 Baldwin et al. ..... 141/98
5,156,238 A * 10/1992 Matthews ..... 187/243
6,695,287 B1 * 2/2004 De Boer ..... 254/10 C
2002/0176768 A1 * 11/2002 Stomski ..... 414/485
2007/0221899 A1 * 9/2007 Braithwaite ..... 254/418
2008/0206030 A1 * 8/2008 Reuille et al. ..... 414/462
2009/0272953 A1 * 11/2009 Wolf ..... 254/7 C
2010/0001241 A1 * 1/2010 Rentschler ..... 254/2 R

* cited by examiner

*Primary Examiner* — Lee D Wilson
*Assistant Examiner* — Melanie Alexander
(74) *Attorney, Agent, or Firm* — George F. Wallace

(57) ABSTRACT

A portable lifting apparatus includes a base having a portability system rendering the apparatus movable along a surface; a lift arm connected to the base; a deck to support an object, and being moveably engaged with the lift arm via a lifting system that is adapted to lift the deck along a portion of the lift arm; and a hitch connector, connected to the deck, and adapted to hitch the apparatus to a vehicle hitch receiver. When the apparatus is not hitched, the lifting system can lift the object from a first position to a second position; and when the apparatus is hitched, the lifting system can lift the apparatus above the surface.

20 Claims, 6 Drawing Sheets

PORTABLE LIFTING APPARATUS

FIELD OF THE INVENTION

The present invention relates to lifting apparatuses, and more specifically, to portable lifting apparatuses.

BACKGROUND OF THE INVENTION

Lifting apparatuses are used to lift objects from a starting point to an ending point relatively above the starting point.

BRIEF SUMMARY OF THE INVENTION

It is, therefore, an object of the present invention to provide a portable lifting apparatus.

In an exemplary embodiment, the present invention can be embodied in a portable lifting apparatus that includes the following: a base having a portability system so as to adapt said portable lifting apparatus to be moved along a surface; at least one lift arm connected to the base; a deck, adapted to support an object having a particular weight, and being moveably engaged with the at least one lift arm via a lifting system adapted to lift the deck along at least a portion of the at least one lift arm; and a hitch connector, connected to the deck, and adapted to engage a hitch receiver of a vehicle. When the portable lifting apparatus is not hitched, the lifting system is adapted to lift such an object from a first position to a second position above the first position; and when the portable lifting apparatus is hitched, the lifting system is further adapted to lift the portable lifting apparatus above the surface.

In another exemplary aspect of the present invention, the portability system can include at least one of a rolling mechanism and a sliding mechanism.

In yet another exemplary aspect of the present invention, the portability system can include a rolling mechanism and at least one foot rest.

In a further exemplary aspect of the present invention, the deck can be substantially flat.

In still another exemplary aspect of the present invention, the deck can include at least one beveled edge.

In another exemplary aspect of the present invention, the deck can include a bottom, and at least one side, connected to the bottom, and being oriented substantially perpendicular to the bottom. Optionally, the deck can include a cover adapted to removably engage the deck. Also optionally, the at least one side can include one or more rails.

In yet another exemplary aspect of the present invention, the deck can include at least one tapered end.

In still another exemplary aspect of the present invention, the deck can include a main portion, and a ramp portion connected to the main portion via one or more hinges. Optionally, the ramp portion can include at least one tapered end.

In a further exemplary aspect of the present invention, the at least one lift arm can include a first lift arm and a second lift arm. Optionally, the portable lifting apparatus of can further comprise at least one cross member connected to the first lift arm and the second lift arm.

In another exemplary aspect of the present invention, the at least one lift arm can be substantially perpendicular to said base.

In still a further exemplary aspect of the present invention, one or more of said at least one lift arm can include one or more gussets.

In another exemplary aspect of the present invention, the lifting system can include a motor adapted to produce lifting energy sufficient to lift the object from the starting point to the ending point above the starting point when said hitch connector is not engaged to the vehicle hitch receiver.

In yet another exemplary aspect of the present invention, the lifting system can include a moveable engagement element connected to said deck and the motor, and when the motor produces the lifting energy, the lifting energy causes at least a portion of the moveable engagement element to move, thereby lifting the object to the ending point.

In a further exemplary aspect of the present invention, the hitch connector can conform to at least one of a class 1, class 2, and class 3 type.

In still yet a further exemplary aspect of the present invention, the portable lifting apparatus can further comprise at least one visibility element connected thereto. Optionally, the portable lifting apparatus can further comprise an electrical coupler adapted, to connect to an electrical source of such a vehicle, and to conductively provide electricity from the electrical source to said at least one visibility element; where said at least one visibility element includes at least one of a brake light, a turn signal light, and a parking light.

BRIEF DESCRIPTION OF THE DRAWINGS

The present invention is illustrated by way of example, and not in limitation, in the figures of the accompanying drawings, in which.

DETAILED DESCRIPTION OF THE INVENTION

The invention will now be described in more detail by way of example with reference to the embodiments shown in the accompanying figures. It should be kept in mind that the following described embodiments are only presented by way of example and should not be construed as limiting the inventive concept to any particular physical configuration, shape, or size.

Figure 1:
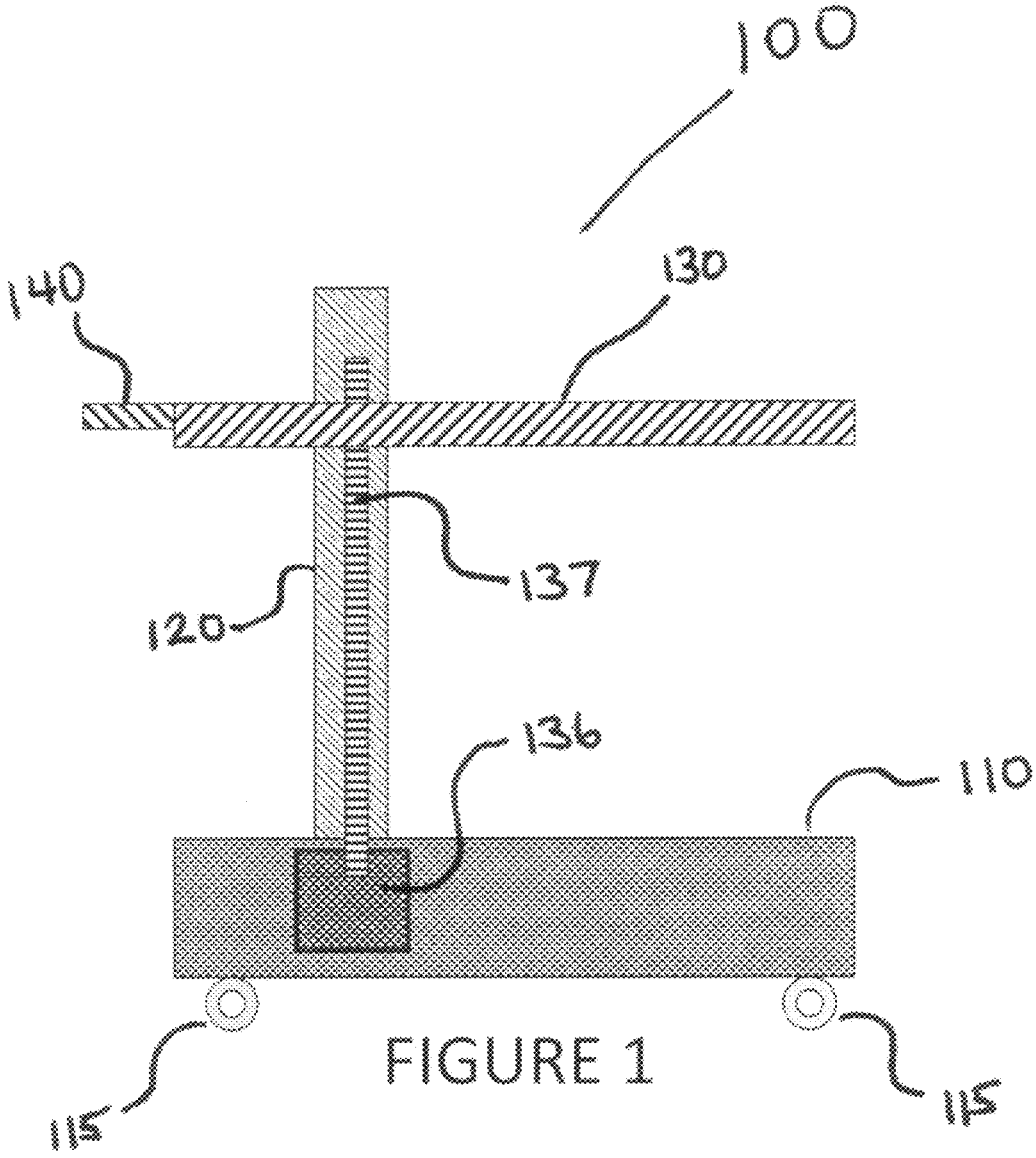
FIG. 1 illustrates an exemplary embodiment having a single lift arm, base, lifting system, deck, and hitch

FIG. 1 illustrates an exemplary embodiment of the present invention, in which a portable lifting apparatus 100 can include a base 110 having a portability system 115, at least one lift arm 120 connected to the base, a deck 130 movably engaged with the at least one lift arm via a lifting system 136,137, and a hitch connector 140 connected to the deck.

Base 110 provides stability (and strength) to apparatus 100, and therefore, can be formed of various materials depending on the stability (and strength) needs of the particular design.

For example, where apparatus 100 is intended to lift and support objects having significant weight (for example, and not in limitation, up to 500 pounds), base 110 can formed from a relatively heavy and strong material, such as steel or cast iron, for example and not in limitation, to provide substantial overall stability and/or strength of the apparatus. Other considerations can include the overall height of apparatus 100, as well as the maximum lifting height of deck 130 (further described infra). As illustrated in FIG. 1, base 110 can be provided in a square or rectangular shape. However, alternative shapes can be provided to the extent desired, such as oval, triangular, oblong, asymmetrical, etc., as long as sufficient overall stability is achieved.

Further, base 110 can include a portability system 115, which is illustrated in this embodiment as a set of wheels 115 disposed at bottom corners of the base. However, it should be noted that various physical element(s) can be employed and positioned to the extent desired. For example, one or more a wheel, roller, track, etc. can be utilized insofar as the same renders apparatus 100 movable along an anticipated surface. It should be further noted that the size and positioning of the physical elements selected for portability system 115 can vary depending on the type of surfaces anticipated or otherwise provided for. For example, larger diameter wheels can be utilized to allow portable lifting apparatus 100 to be moved on or over rough or uneven terrain, such as grass or otherwise non-smooth or discontinuous surfaces. Further, shock absorbing elements (not shown) may additionally be included. Notably, portability system 115 can further include one or more foot rests, such as in an embodiment with one or more rolling mechanisms on one side and the one or more foot rests on an opposite side, such that apparatus 100 can be movable when lifted and fixed in a location when not. Also notably, portability system 115 can include a locking mechanism (not shown), so as to lock any wheels or rolling mechanisms utilized and/or to abut the lower surface (e.g., the ground) so as to provide static friction.

As further illustrated in FIG. 1, apparatus 100 further includes at least one lift arm 120 connected to base 110. As with base 110, lift arm 120 can be formed from various materials depending on the strength and/or stability needs of the particular design. Anticipated weight loads and overall height considerations can be at least two considerations in the selection of the utilized material or materials. Further, lift arm 120 can include one or more gussets (not shown) to provide additional strength and lifting capacity to the lift arm(s). Lift arm 120 provides guidance to motion of deck 130; i.e., the deck can be moved along at least a portion of the length of the lift arm.

Figure 2:
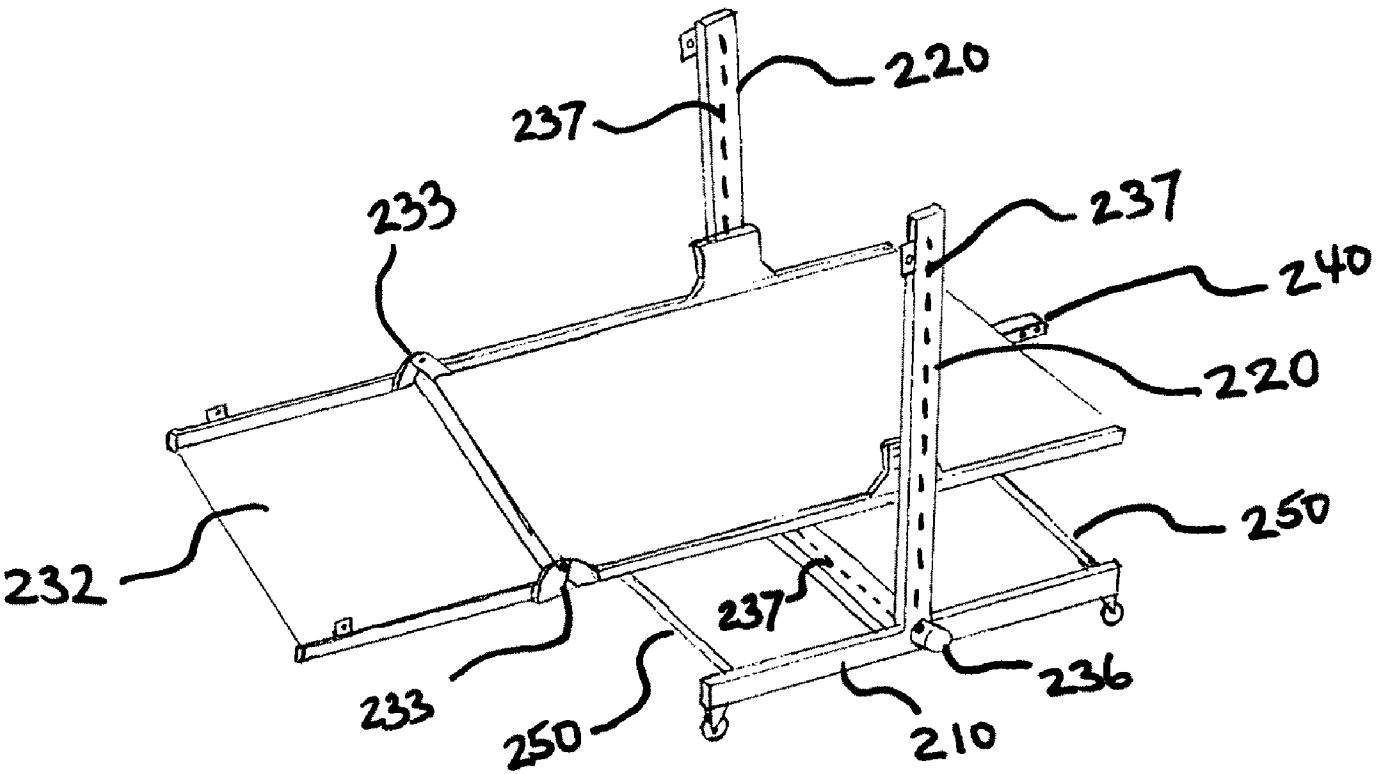
FIG. 2 illustrates an exemplary embodiment having a dual base/lift arm configuration with an energy transfer element and safety lighting element.

It should be noted that base 110 and/or lift arm 120 can be provided in multiple instances, such as two, three, or more instances. For example and not in limitation, as alternatively illustrated in FIG. 2, base 210 (one base not visible) and/or lift arm 220 can be provided in pairs. In an embodiment with multiple instances of lift arm 220, cross members 250 can be optionally provided between two or more bases 210 and/or lift arms 220 to provide additional overall strength of apparatus 200. Additionally, optionally transfer element 237 can be provided in one or more instances, such that lifting energy can be provided for one or more lift arms 220. Also illustrated is optional ramp 232 that can be connected to deck 230 via one or more connecting elements 233, such as hinges, for example and not in limitation.

FIG. 1 additionally illustrates deck 130, which can be adapted to support an object (not shown), which can include one or more materials, such as dirt, an engine block, sand, etc. According to the present invention, deck 130 can be any shape desired that sufficiently holds one or more intended objects. For example, and not in limitation, deck 130 can be round, oval, square, rectangular, oblong, asymmetrical, etc. Further, for example and not in limitation, deck 130 can be flat, substantially flat, concave, textured, etc., insofar as the deck sufficiently holds an anticipated object(s). Deck 130 can be moveably engaged with lift arm 120 via a lifting system, which in this embodiment can include a motor 136 adapted to generate lifting energy and one or more transfer elements 137 adapted to transfer lifting energy to deck 130, moving the deck along lift arm 120. It should be further noted that motor 136 can be mounted in any desired, functionally-consistent position and/or location on apparatus 100 desired.

According to the present invention, any form of transfer element 137 sufficient to transfer lifting energy to lift arm 130 may be utilized, and the particular one or more thereof selected is a design choice that will be apparent to one of ordinary skill in the art given whichever design choices selected given this enabling disclosure. Exemplary transfer elements can include one or more of a screw-drive, drive-shaft, chain-drive, belt-drive, and rack and pinion elements, etc., and complementary elements required, for example and not in limitation. Also according to the present invention, motor 136 can be any type of motor insofar as sufficient lifting energy is produced, such as, for example and not in limitation, an electric, hydraulic, pneumatic, or mechanical motor. If electric, motor 136 can include an electrical connection (not shown) adapted to electrically engage a direct or alternating current electrical source, such as a vehicle battery or an electrical outlet of a structure or generator, for example and not in limitation. If mechanical, motor 136 can be user-operated, such as via a crank or ratchet, whether hand or foot activated, for example and not in limitation. Optionally, one or more of thrust, support, and idler bearings (not shown) can be incorporated into lifting system 136, 137 to enhance moveable engagement of deck 130 with lift arm 120.

As further illustrated in FIG. 1, hitch connector 140, is connected to deck 130, and is adapted to hitch apparatus 100 to a vehicle hitch receiver (not shown). According to the present invention, hitch connector 140 can optionally be provided in a form compatible with a pre-existing class of hitch receivers, such as a ball, Class I, II, or III Type, for example and not in limitation.

It should be noted that two highly advantageous features of the present invention stem from this hitching aspect. First, when apparatus 100 is hitched to a vehicle hitch receiver (not shown), actuating lifting system 136,137 can lift base 110 off the ground, thus allowing the vehicle (not shown) to be moved with the apparatus attached thereto without any portion of the apparatus being in contact with the ground. Second, when apparatus 100 is not hitched to a vehicle, actuating lifting system 136,137 can lift deck 130 (and any object(s) placed thereon) from a first position to a second position above the first, with the base contacting the ground (surface) and supporting the apparatus in a free-standing manner.

Figure 3:
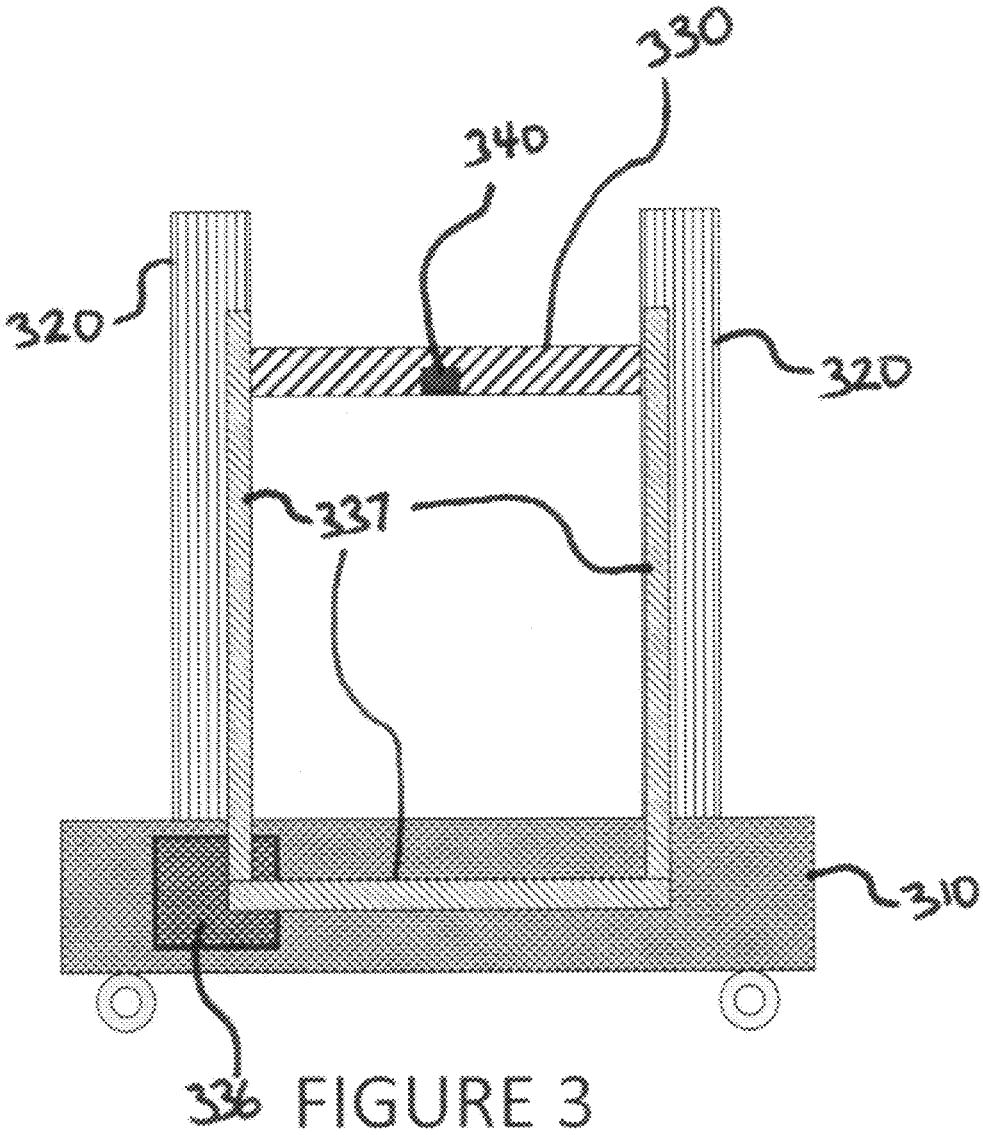
FIG. 3 illustrates another exemplary embodiment having a two-lift lift arm configuration.

FIG. 3 illustrates yet another exemplary embodiment of the present invention, in which transfer element 137 can include plural elements for transferring lifting energy from motor 136 to one or more lift arms 120.

Figure 4A:
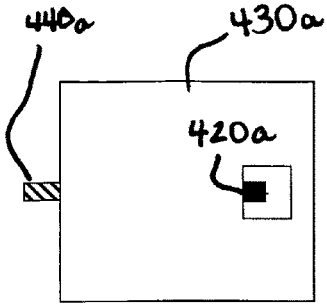
FIG. 4*a* illustrates an exemplary deck for a single lift arm configuration.
Figure 4B:
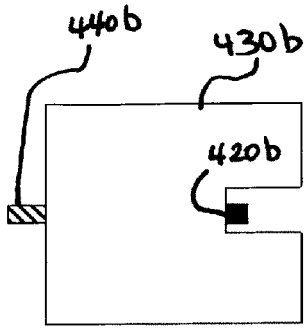
FIG. 4*b* illustrates another exemplary deck for a single lift arm configuration.
Figure 4C:
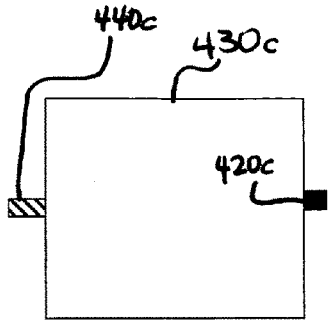
FIG. 4*c* illustrates a further exemplary deck for a single lift arm configuration.
Figure 4D:
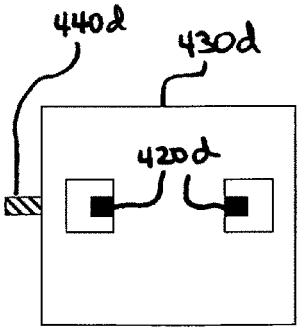
FIG. 4*d* illustrates an exemplary deck for a multiple lift arm configuration.
Figure 4E:
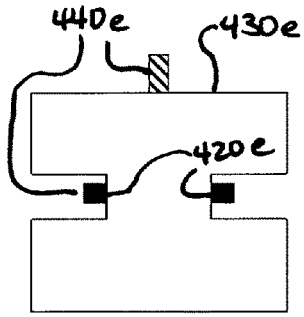
FIG. 4*e* illustrates another exemplary deck for a multiple lift arm configuration.
Figure 4F:
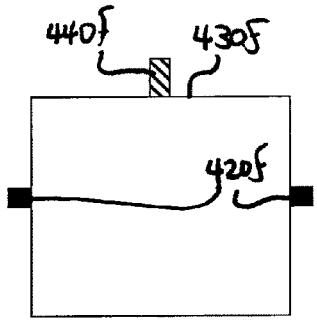
FIG. 4*f* illustrates a further exemplary deck for a multiple lift arm configuration.

FIGS. 4*a*-4*f* illustrate top-views of various exemplary decks according to the present invention, but notably, are not limited thereby in size, shape, or configuration. FIGS. 4*a*-4*c* illustrate exemplary decks that can be utilized in single lift arm embodiments, while FIGS. 4*d*-4*f* illustrate ones that can be utilized in dual lift arm embodiments. As illustrated, decks 430*a-f* can be substantially flat, but may be provided in any shape with any angles and/or textures consistent with the teachings herein. Further, it should be noted that deck 430 according to the present invention can include one or more beveled edges and/or can include one or more sides (not shown, which may or may not be perpendicular to the bottom of deck 430) extending upwardly to assist in holding one or more objects. According to the present invention, such sides can be solid or include apertures therein, for example and not in limitation. Further, sides can be provided in the form of one or more rails, for example and not in limitation. Where deck 430 is provided with one or more sides, a cover (not shown), which may or may not be removably engaged with the deck, can be provided.

Figure 5A:
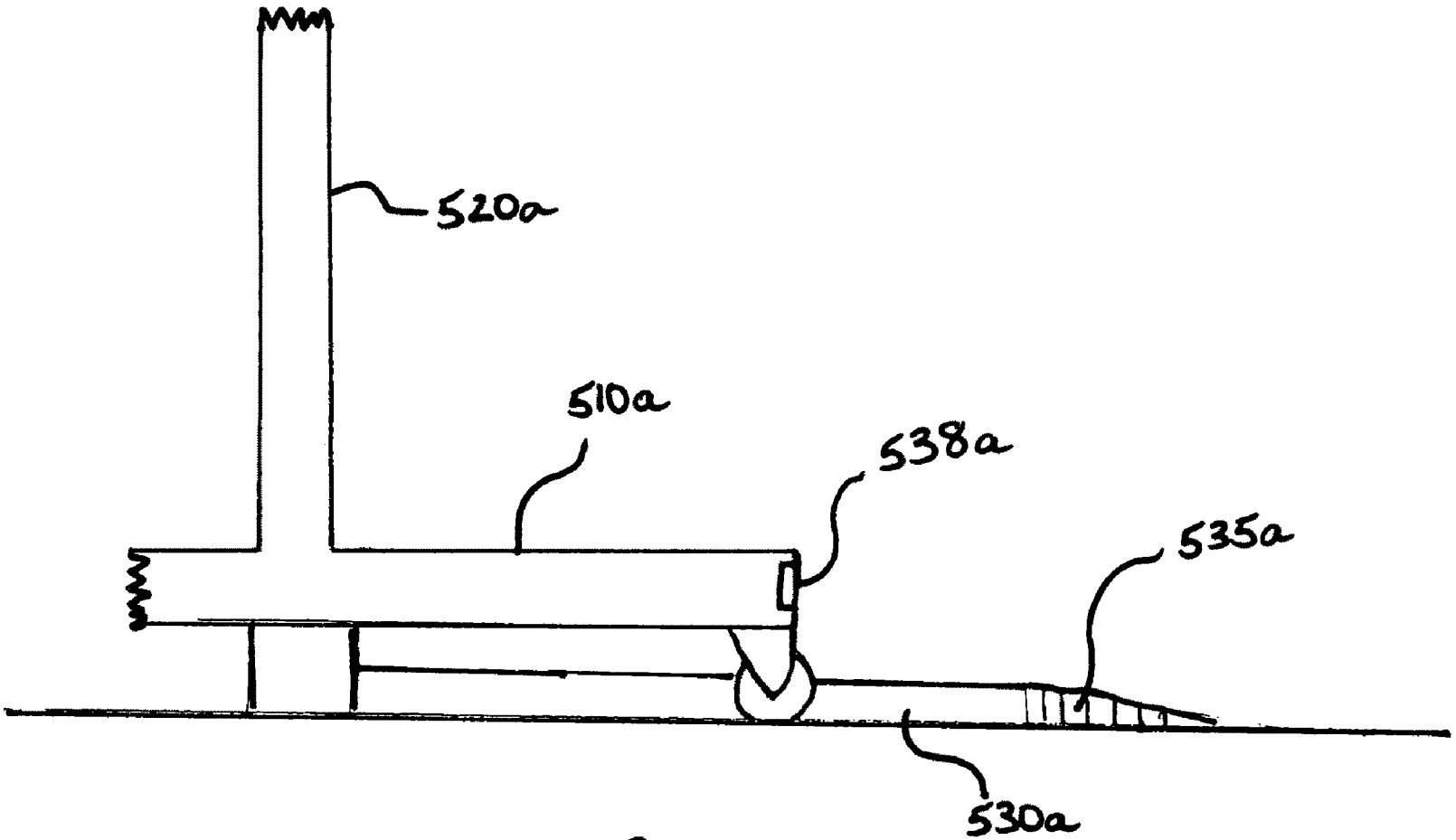
FIG. 5*a* illustrates an exemplary deck having a tapered end.
Figure 5B:
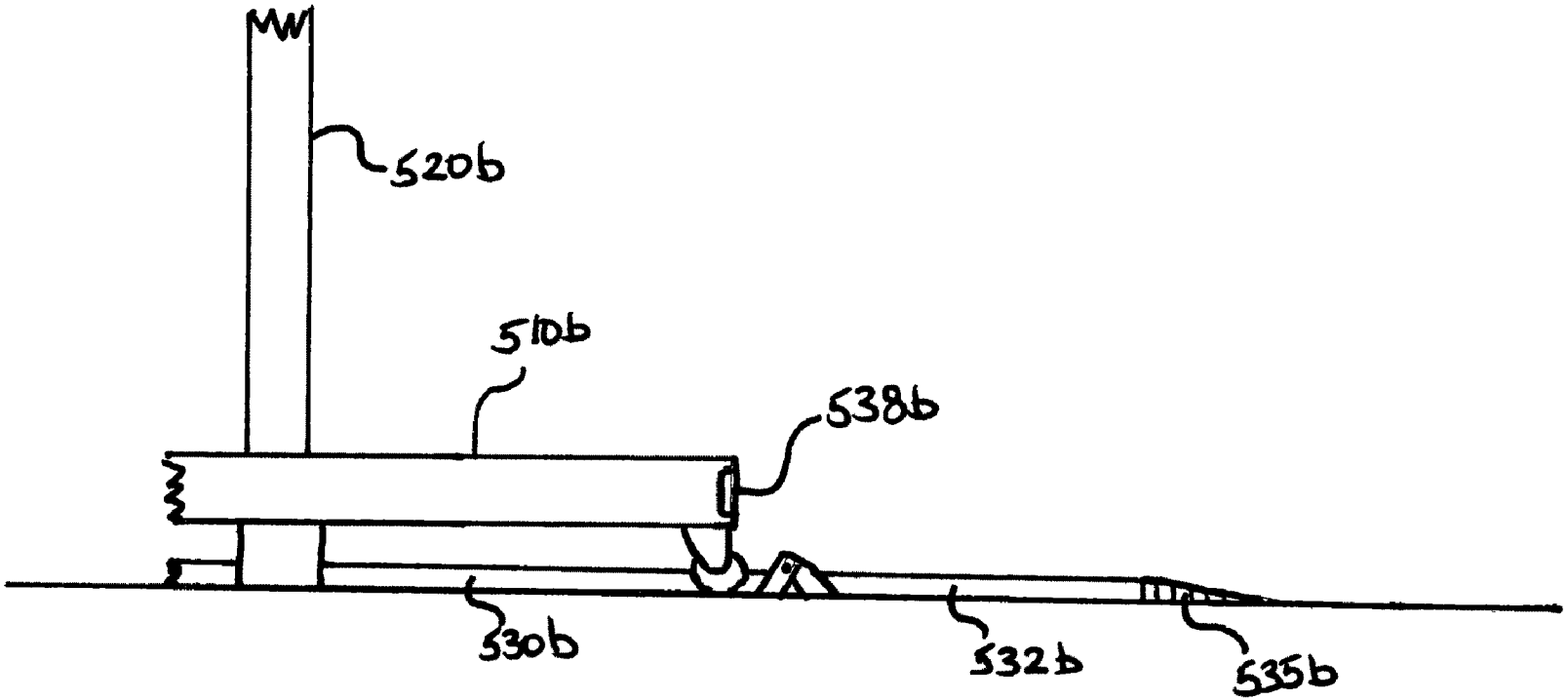
FIG. 5*b* illustrates an exemplary deck having a ramp portion with a tapered end.

As illustrated in FIG. 5*a*, deck 530*a* can include a tapered end 535*a* to assist the loading of one or more objects onto the deck when the deck is lowered to or near a surface below base 510*a*. As illustrated in FIG. 5*b*, deck 530*b* can optionally include a ramp 532*b* that can be connected to deck 530*b* via one or more hinges or similar mechanical element(s), and can incorporate tapered end 535*b*.

As further illustrated in FIGS. 5*a* and 5*b*, optionally, one or more visibility elements 538*a*, 538*b* can be attached to the present invention to improve visibility of the apparatus when hitched to a vehicle. An exemplary visibility element can include one or more of a light and/or a light reflecting element. Further, a light can functionally acts as a turn signal light, brake light, and/or parking light, and electrical power can be provided by a battery, which can be a vehicle battery and/or a dedicated battery. Further optionally, apparatus 100 can include a vehicular electrical coupler adapted to provide power and/or control over one or more lights 538.

It will be apparent to one of ordinary skill in the art that the manner of making and using the claimed invention has been adequately disclosed in the above-written description of the exemplary embodiments and aspects taken together with the drawings.

It should be understood, however, that the invention is not necessarily limited to the specific embodiments, aspects, arrangement, and components shown and described above, but may be susceptible to numerous variations within the scope of the invention. Accordingly, the specification and drawings are to be regarded in an illustrative and enabling, rather than a restrictive, sense.

Therefore, it will be understood that the above description of the embodiments of the present invention are susceptible to various modifications, changes, and adaptations, and the same are intended to be comprehended within the meaning and range of equivalents of the appended claims.

Therefore, I claim:

1. A portable lifting apparatus, comprising:

a base having a portability system configured to render the portable lifting apparatus movable along a surface;

at least one lift arm connected to said base;

a deck, configured to support an object having a particular weight, and being moveably engaged with said at least one lift arm via a lifting system includes roller and guide having a guide configured to lift said deck along at least a portion of said at least one lift arm; and a hitch connector, connected to said deck, and configured to hitch the portable lifting apparatus to a vehicle hitch receiver;

wherein when the portable lifting apparatus is not hitched, the lifting system is configured to lift such an object from a first position to a second position above the first position; and when the portable lifting apparatus is hitched, the lifting system is further configured to lift the portable lifting apparatus above the surface with said base fixedly mounted to said lifting system which allows said deck to move relative to said base and lifting system, which are fixedly mounted together.

2. The portable lifting apparatus of claim 1, wherein the portability system includes at least one of a rolling mechanism and a sliding mechanism.

3. The portable lifting apparatus of claim 1, wherein the portability system includes a rolling mechanism and at least one foot rest.

4. The portable lifting apparatus of claim 1, wherein said deck is substantially flat.

5. The portable lifting apparatus of claim 1, wherein said deck includes at least one beveled edge.

6. The portable lifting apparatus of claim 1, wherein said deck includes a bottom and at least one side, connected to the bottom, and being oriented substantially perpendicular to the bottom.

7. The portable lifting apparatus of claim 6, wherein said deck includes a cover adapted to removably engage said deck.

8. The portable lifting apparatus of claim 6, wherein the at least one side includes one or more rails.

9. The portable lifting apparatus of claim 1, wherein said deck includes at least one tapered end.

10. The portable lifting apparatus of claim 1, wherein said deck includes a main portion and a ramp portion connected to the main portion via one or more hinges.

11. The portable lifting apparatus of claim 10, wherein the ramp portion includes at least one tapered end.

12. The portable lifting apparatus of claim 1, wherein said at least one lift arm includes a first lift arm and a second lift arm.

13. The portable lifting apparatus of claim 12, further comprising at least one cross member connected to the first lift arm and the second lift arm.

14. The portable lifting apparatus of claim 1, wherein said at least one lift arm is substantially perpendicular to said base.

15. The portable lifting apparatus of claim 1, wherein one or more of said at least one lift arm includes one or more gussets.

16. The portable lifting apparatus of claim 1, wherein the lifting system includes a motor adapted to produce lifting energy sufficient to lift the object from the starting point first position to the ending point second position above the starting point first position when said hitch connector is not engaged to the vehicle hitch receiver.

17. The portable lifting apparatus of claim 16, wherein the lifting system includes at least one transfer element connected to said deck and the motor, and when the motor produces the lifting energy, the lifting energy causes at least a portion of the transfer element to move, thereby lifting the object to the ending point.

18. The portable lifting apparatus of claim 1, wherein the hitch connector conforms to at least one of a class 1, class 2, and class 3 types.

19. The portable lifting apparatus of claim 1, further comprising at least one visibility element connected thereto.

20. The portable lifting apparatus of claim 19, further comprising an electrical coupler adapted to connect to an electrical source of such a vehicle and to conductively provide electricity from the electrical source to said at least one visibility element; wherein said at least one visibility element includes at least one of a brake light, a turn signal light, and a parking light.

* * * * *